US006162094A

United States Patent [19]

Huang

[11] Patent Number: 6,162,094

[45] Date of Patent: Dec. 19, 2000

[54] CONNECTOR HOUSING

[75] Inventor: Wayne Huang, Alhambra, Calif.

[73] Assignee: Hon Hai Precision Ind. Co., Ltd., Taipei Hsien, Taiwan

[21] Appl. No.: 09/404,441

[22] Filed: Sep. 22, 1999

[51] Int. Cl.[7] ..... H01R 13/648

[52] U.S. Cl. ..... 439/610; 439/906

[58] Field of Search ..... 439/607–610, 439/606, 901, 904, 906

[56] References Cited

U.S. PATENT DOCUMENTS 5,425,657 6/1995 Davis et al. ..... 439/610
5,667,407 9/1997 Frommer et al. ..... 439/610
5,761,805 6/1998 Guyer ..... 29/883
5,766,033 6/1998 Davis ..... 439/405
5,833,495 6/1998 Ito ..... 439/610

*Primary Examiner*—Gary F. Paumen
*Attorney, Agent, or Firm*—Wei Te Chung

[57] ABSTRACT

A connector housing comprises upper and lower covers mated to form the housing. Upper and lower shells are integrally molded with the upper and lower covers, wherein at least a portion of one of the upper and lower shells protruding over the corresponding cover.

2 Claims, 4 Drawing Sheets

CONNECTOR HOUSING

FIELD OF THE INVENTION

The present invention relates to a connector housing, and more particularly to a connector housing integrally formed with an EMI shield which has at least a portion not been covered by the housing.

DESCRIPTION OF THE PRIOR ART

EIA, Electrical Industries Association, releases a Standards Proposal No. 3652-A, Proposed New Specification "Detail Specification for Trapezoidal Shielded Connector 0.8 mm Pitch Used with Very High Density Cable Interconnect (BHDCI)" wherein two trapezoidal shielded female connectors are stacked in a mirror-image arrangement. In addition, the trapezoidal mating portions are not located centrally with respect to their housings. In order to have two male connectors fit to the stacked female connectors, the island and the shroud portions are offset from a central line thereof.

U.S. Pat. Nos. 5,761,805 and 5,766,033 issued to Guyer and Davis disclose method for making a high density connector and high density connector, respectively. The connectors disclosed meet the requirements set in the above mentioned Standards. After the connector housing is terminated with conductive wires, an over-molding process will be performed to enclose a plastic layer over the connector housing. Since the mating portion is offset arranged, the bottom wall of the shell member will become a critical point during the over-molding process.

According to the actual practice, for the reason of easy molding the thickness of the plastic layer (P) over the bottom wall (64) of the shell member (14) shall at least for 1.00 mm, as shown in FIG. 1. This also provides enough rigidity to sustain external impact. However, when the bottom wall (64) of the shell member (14) is offset to accommodate the connector housing, the plastic layer deployed over the bottom wall (64) is reduced to 0.6 mm rendering the over-molding process over the bottom wall (64) becomes extremely difficult in light of the plastic flow within such a tiny gap between the bottom wall (64) and an inner wall of the mold cavity, as shown in FIG. 2. In order to inject the molten plastic through the 0.6 mm gap, injection pressure have to increase and the manufacturing cost is increased inevitably. In addition, even the thin layer is finally formed, it is vulnerable to external impact and can not provide any protection. Many efforts have been applied to overcome this problem and none of them is acceptable.

SUMMARY OF THE INVENTION

An objective of this invention is to provide a connector housing integrally formed with an EMI shield which has at least a portion not been covered by the housing.

In order to achieve the object set forth, a connector housing in accordance with the present invention comprises upper and lower covers mated to form said housing. Upper and lower shells integrally are molded with said upper and lower covers, respectively. At least a portion of one of said upper and lower shells protrudes over said corresponding cover.

According to one aspect of the invention, the protruded portion of the upper and lower shells flushes to the outer surface of the corresponding cover.

These and additional objects, features, and advantages of the present invention will become apparent after reading the following detailed description of the preferred embodiments of the invention taken in conjunction with the appended drawings.

DETAILED DESCRIPTION OF THE PREFERRED EMBODIMENT

Figure 1:
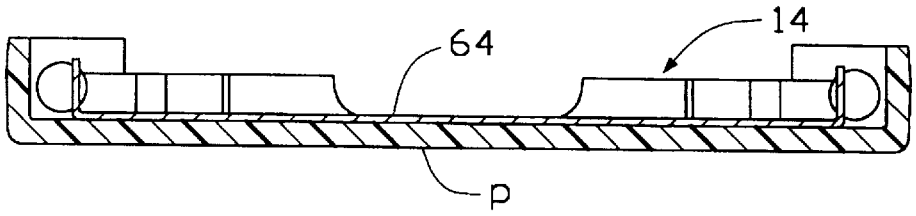
FIG. 1 (PRIOR ART)
FIG. 1 is a cross sectional view showing a prior art arrangement.
Figure 2:
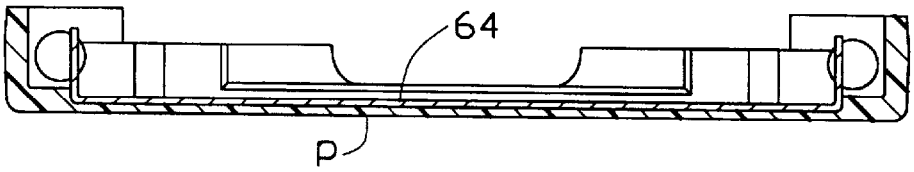
FIG. 2 (PRIOR ART)
FIG. 2 is still a cross sectional view showing a prior art arrangement.

Referring to FIGS. 3 to 6, an electrical connector 1 in accordance with the present invention comprises a housing 10 configured by upper and lower covers 10*a* and 10*b*. Upper (not shown) and lower shell 11 are integrally formed with the upper and lower covers 10*a*, 10*b* to barrier EMI. A shroud 12 is assembled to a connector core 13 to provide EMI shield around a mating portion 13*a* thereof. A pair of spacers 14 is assembled to a terminating plane 13*b* of the terminal core 13. Each spacer 14 carries a plurality of conductive wires 15 and completes terminations between the conductive wires 15 and termination sections 13*c* of the connector core 13. The subject matter of the instant invention is focused in the arrangement between the lower shell 11 and the lower cover 10*b*, hence description will be focused thereto. No detailed description will be given to the connector core 13 and the spacers 14.

Figure 6:
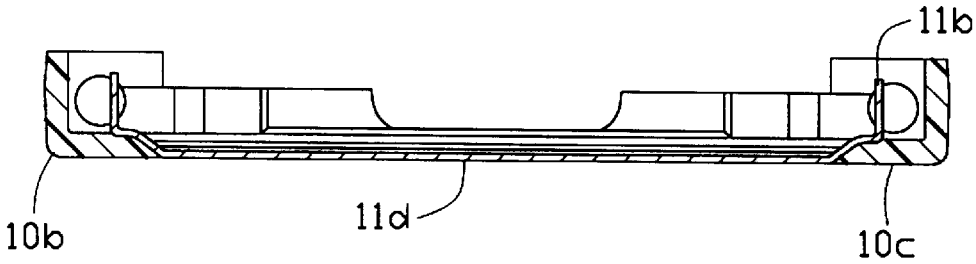
FIG. 6 is a cross sectional view taken along 6—6 of FIG. 4.
Figure 3:
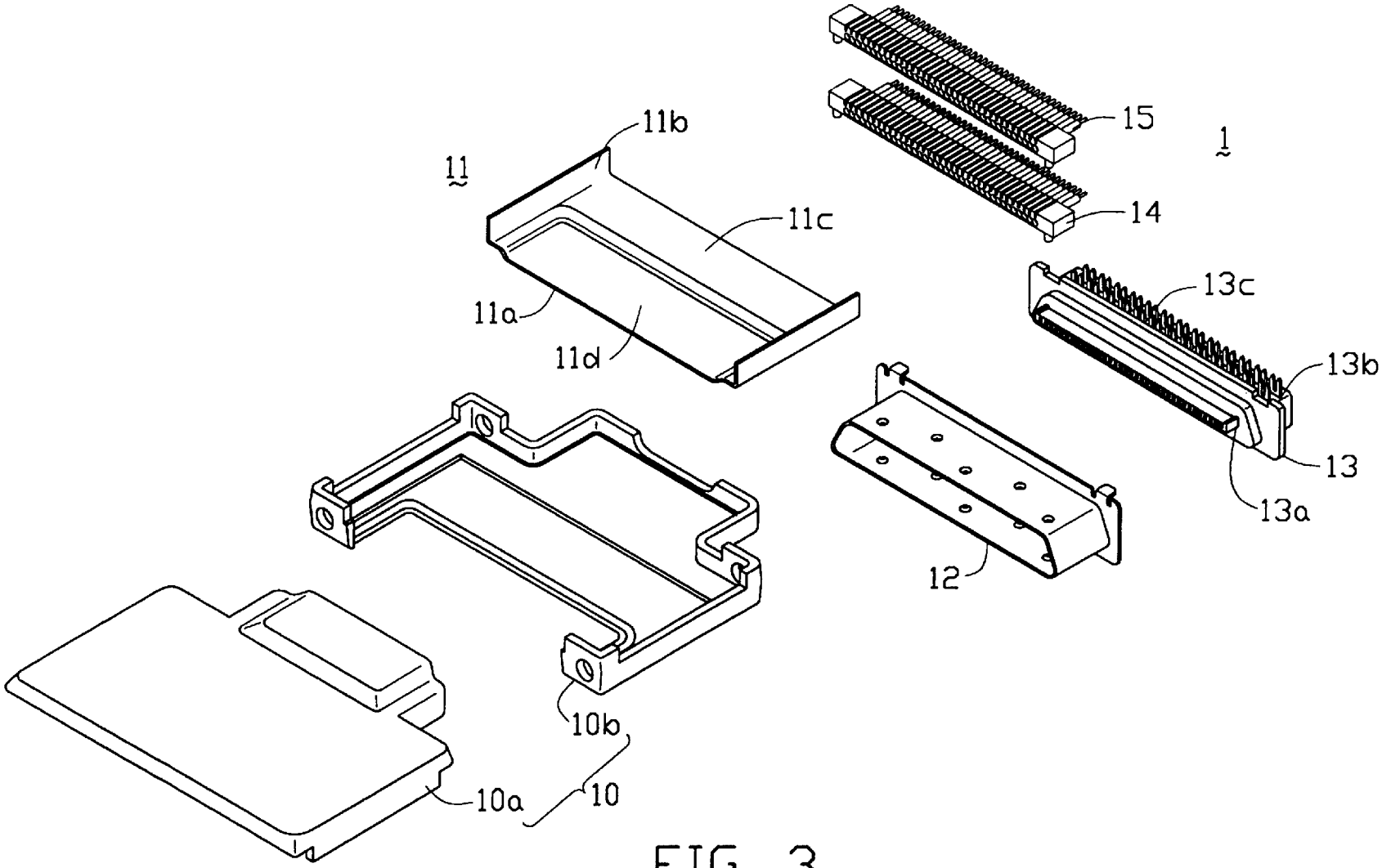
FIG. 3 is an exploded view of a connector in accordance with the present invention.
Figure 4:
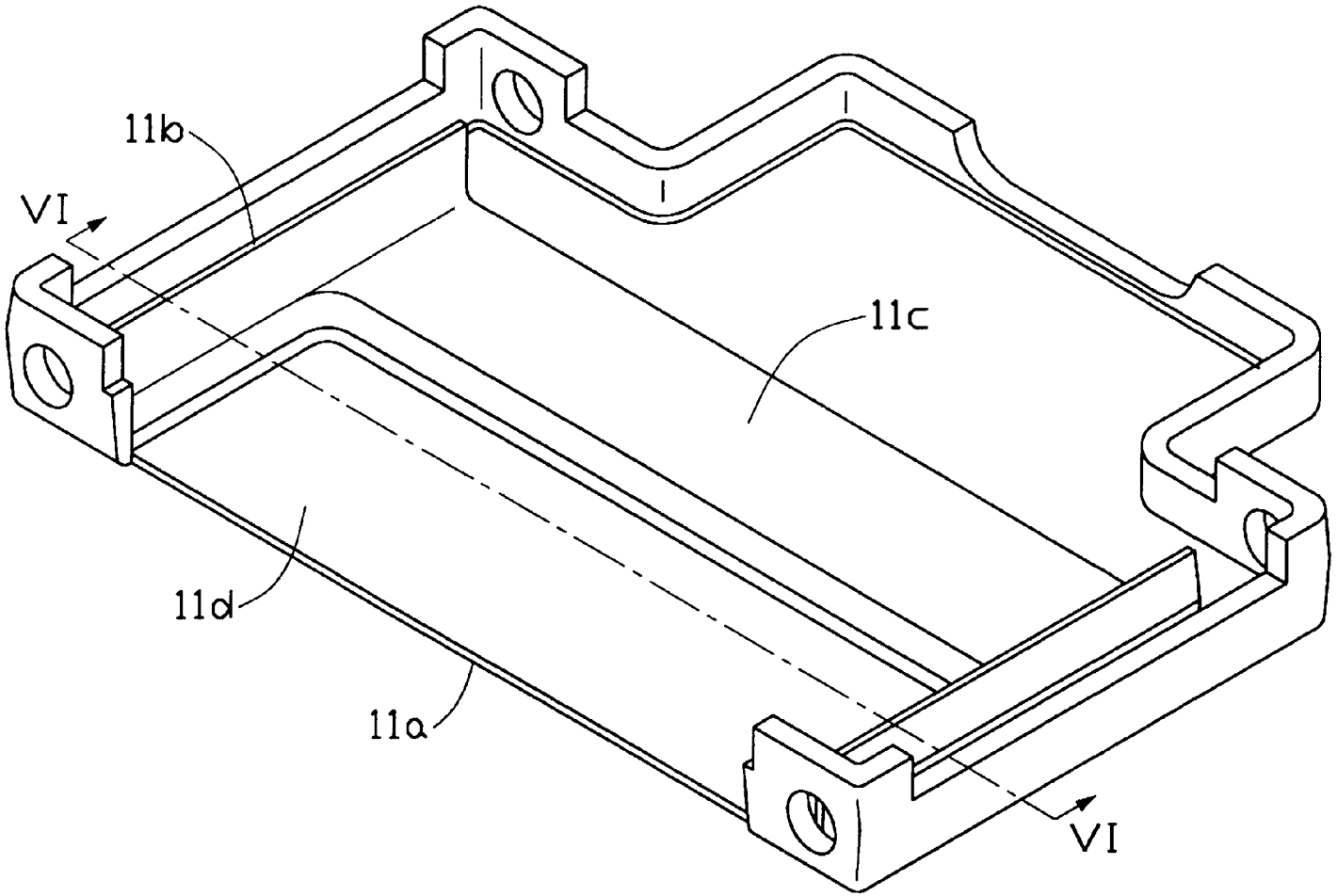
FIG. 4 is a perspective view of a lower cover with a lower shell of FIG. 3 integrally formed therewith.
Figure 5:
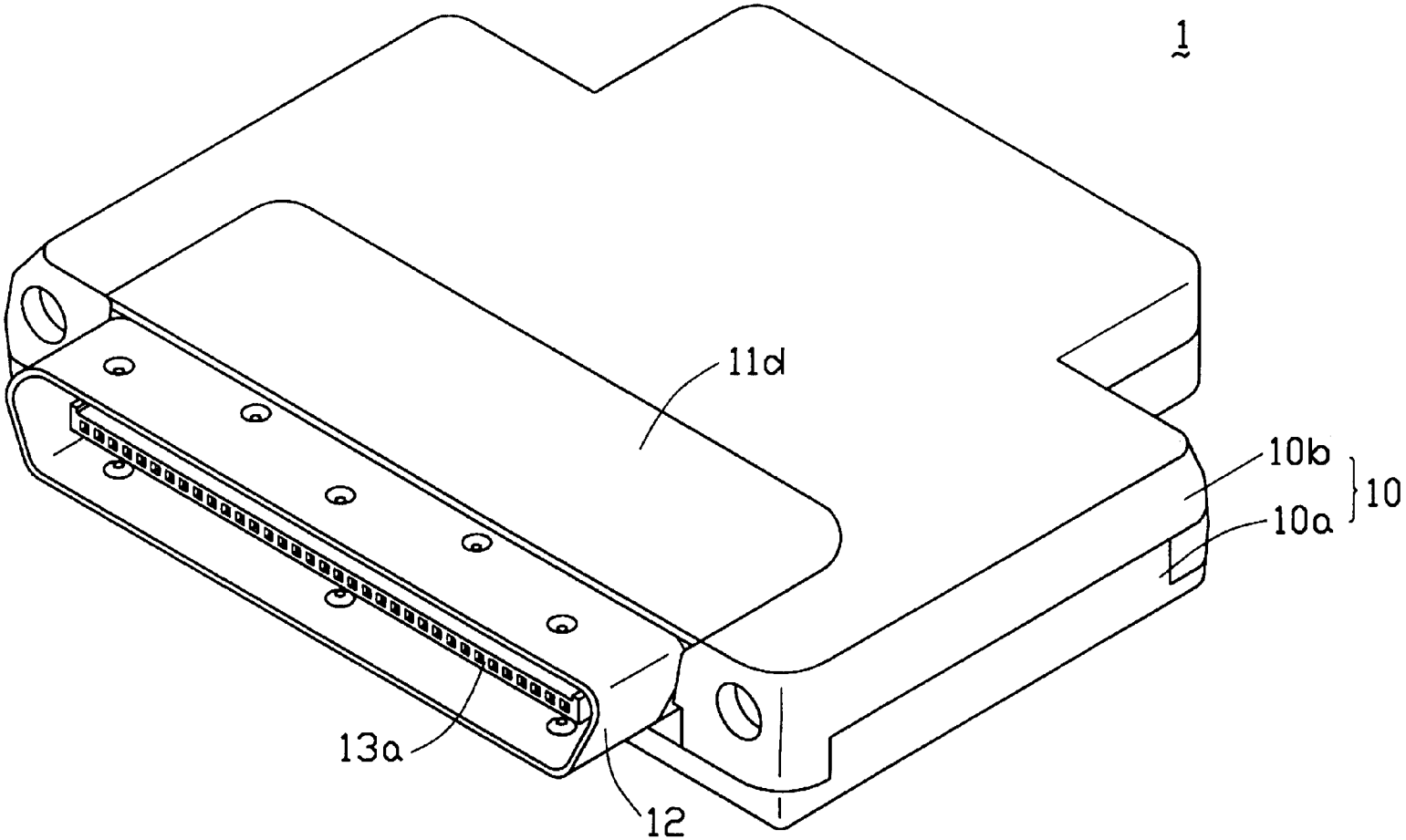
FIG. 5 is an assembled view of FIG. 3.

The lower shell 11 includes a body portion 11*a* having a pair of side walls 11*b* extending from transversal ends thereof. The body portion 11*a* includes a flat portion 11*c* and a recessed portion 11*d* which is adapted to accommodate the terminal core 13 therein. When the lower shell 11 is integrally molded with the cover 10*b*, the recessed portion 11*d* abuts against an inner wall of a mold cavity (not shown) directly, accordingly there is not a gap between the recessed portion 11*d* and the inner wall of the lower shell 11 thereby putting the molding process easier and smoothly since the injection pressure of the molten plastic does not need to increase. Furthermore, as the recessed portion 11*d* abuts against the inner surface of the mold, it flushes to an outer face 10*c* of the lower cover 10*b* after molding process (FIG. 6). From another viewpoint, the molded lower cover defines a recess (not labeled) for receiving the recessed portion 11*d* therein.

On the other hand, because there is still a normal gap between the flat portion 11*c* and the inner surface of the mold cavity, the flat portion 11*c* is still covered with a layer of plastic as conventional.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A connector housing assembly, comprising:

upper and lower covers mated to form a housing, and upper and lower metal shells embedded in with said upper and lower covers, wherein a substantial portion of said lowered shell is flush with and not covered by the outer surface of said lower cover.

2. A connector assembly comprising:

an insulative housing comprising upper and lower covers;

a terminal core with a plurality of terminals thereon positioned within the housing; and a metal shell generally surrounding said terminal core and positioned between said terminal core and said housing, said shell including a recessed portion; wherein one of said upper and lower covers forms a recess to receive said recessed portion therein so that said recessed portion of the shell is exposed to an exterior through said recess and is flush with an outer face of said one of the upper and lower covers, said recessed portion extending over a substantial portion of said on cover.

* * * * *